US005460217A

United States Patent [19]

Sakurai et al.

[11] Patent Number: 5,460,217

[45] Date of Patent: Oct. 24, 1995

[54] APPARATUS AND METHOD FOR WAX TREE COATING AND PRODUCT MANUFACTURING METHOD USING THE APPARATUS AND METHOD

[75] Inventors: Kazuo Sakurai; Tosiaki Watanabe, both of Aichi, Japan

[73] Assignee: Mitsubishi Denki Kabushiki Kaisha, Tokyo, Japan

[21] Appl. No.: 154,440

[22] Filed: Nov. 19, 1993

[30] Foreign Application Priority Data

Aug. 25, 1993 [JP] Japan ..... 5-210518

[51] Int. Cl.[6] ..... B22C 9/02; B22C 13/08

[52] U.S. Cl. ..... 164/35; 164/165; 164/166

[58] Field of Search ..... 164/165, 166, 164/516

[56] References Cited

U.S. PATENT DOCUMENTS

| | | | |
|---|---|---|---|
| 3,796,251 | 3/1974 | Jasson et al. | 164/166 |
| 3,888,299 | 6/1975 | Bardet | 164/166 |
| 4,727,929 | 5/1988 | Simmons et al. | 164/166 |
| 4,919,193 | 4/1990 | Sasaki | 164/516 |

FOREIGN PATENT DOCUMENTS

| | | |
|---|---|---|
| 55-86657 | 6/1980 | Japan . |
| 2-258142 | 10/1990 | Japan . |

*Primary Examiner*—Mark Rosenbaum
*Assistant Examiner*—I.-H. Lin
*Attorney, Agent, or Firm*—Sughrue, Mion, Zinn, Macpeak & Seas

[57] ABSTRACT

An apparatus and a method for manufacturing cast parts by means of a lost wax process which is fully automated and unmanned. The wax tree coating processes, ranging from after a wax tree manufacturing step to immediately before a dewaxing step comprises a handling device for handling wax trees, a pair of slurry fluid dipping baths disposed with the handling device in between, a pair of sanding fluidized bed tanks disposed with the handling device in between, and a pair of conveyors for suspending and transferring the wax trees for not less than given drying time, wherein the handling device chucks the wax tree suspended and transferred by the conveyor at a given transfer position by means of a clamp unit of the handling device, moves the wax tree to the slurry fluid dipping bath and then to the sanding fluidized bed tank to coat the wax tree with a slurry fluid and sand, and returns the coated wax tree to the hanger conveyor again, with the sequence of operations automatically controlled by a controller.

20 Claims, 13 Drawing Sheets

APPARATUS AND METHOD FOR WAX TREE COATING AND PRODUCT MANUFACTURING METHOD USING THE APPARATUS AND METHOD

BACKGROUND OF THE INVENTION

1. Field of the Invention

The present invention relates to an apparatus and a method for manufacturing lost wax molds for making cast parts manufactured with a lost wax process and to cast parts made from the molds resulting from such a manufacturing method, and particularly to a lost wax mold manufacturing method which allows each process of lost wax mold manufacturing to be unmanned, automatic and continuous.

2. Description of the Background Art

The cost of manufacturing metallic parts and the like having many parts or complicated shape that need to be machined can be sharply reduced by changing the manufacturing method to a die casting or casting using a lost wax. While die casting is limited to the metal materials of aluminum or its alloy, lost wax is applicable to a variety of metallic parts made of such materials as iron and copper.

As is already known, a wax tree 1 is made by joining one or more wax product-patterns 2 and a gate stick 3 as shown in FIG. 15. The mold made from a lost wax process is used for manufacturing metallic parts, as indicated in FIG. 14*a*. Initially, the wax tree is assembled and degreased (steps S11 and S12). Subsequently, in a series of successive coating and drying steps (S13–S26) the wax tree is put into a slurry dipping bath filled with a slurry fluid to coat the wax tree evenly with the slurry fluid to prevent bubbles from sticking thereto, is rid of the fluid, and is then coated with sand in a sanding fluidized bed tank and dried. These steps are repeated to provide the wax tree with several coats of sand until the wax tree is thick enough to endure pouring pressure. The combination of assembled wax patterns which are coated with sand are generically referred to as the wax tree (or the tree). Then, in step S27, the sand-coated wax tree is heated to fuse and run off the wax (dewax), and the remaining sand mold is calcined (step S28). Subsequently, molten metal is poured through the sprue of the sand mold, the sand mold is cooled and broken to separate a desired metallic part therefrom for use as a product or a product part (steps S29–S31).

Among the several coats of sand thus applied, the first coat that relates to the casting surface of the part uses fine sand in order to assure a good surface finish. Since bubble build-up between the wax tree and the slurry fluid in the first coating deteriorates the casting surface, a worker checks for bubbles and removes them, if any, with a spoon tool or the like. The third to the sixth coating processes, which are identical in procedure to but are different in sand roughness from the first coating, comprise dipping, fluid ridding, sanding and sand stripping (steps S111–S114), as indicated in FIG. 14*b*. Unlike the first and the third to the sixth coating processes, the second coating process pre-dips the wax tree (step S110) to prevent bubbles from occurring between the first coat of sand and the slurry fluid before it is dipped in the slurry fluid as indicated in FIG. 14*c*. The seventh coating process, which includes only dipping into the slurry fluid and fluid ridding as indicated in FIG. 14*d*, is conducted to ensure that the sixth coat of sand is applied to the wax tree more reliably.

In the above lost wax mold manufacturing process, wax trees produced on a small to medium scale were coated manually in most cases, and if a partially mechanized method is employed, coating was supplemented by manual work.

FIG. 16 is a plan view of an automatic coating apparatus presented in Japanese Laid-Open Patent Publication No. SHO55-86657, wherein the numeral 101 indicates wax trees and 102 designates wax tree carts which transport the wax trees 101. 103 denotes a wax tree removing device, 104 represents a slurry dipping device, 105 indicates an excess slurry centrifuging device, 106 denotes a sanding device, and 108 represents a wax tree transfer device. These devices are arranged at equal intervals on a circumference with a wax tree feeding device 109 at the center. A spare slurry tank 110 and a spare sand tank 111 are disposed at the back of the slurry dipping device 104 and the sanding device 106, respectively. The wax tree carts 102 are set on rotary tables 112. 113 designates a control panel which controls all functions to handle all these components as an integrated system.

FIG. 17*a* is a partial plan view of the wax tree feeding device 109 and FIG. 17*b* is a partial front view thereof, wherein 109*a* indicates a hydraulic cylinder for moving a vertical spindle 109*b* up and down. At the top of the spindle 109*b*, there are six beams 109*f* extending at intervals of 60° perpendicularly to the spindle on a level with each other. The beams 109 are swung 60° by a rotary cylinder 109*d*. At the end of each beam 109*f*, an arm seat 109*h* is movable by a hydraulic cylinder 109*g* in the longitudinal direction of the beam along a slide shaft 109*i* and the arm seat 109*h* is fitted with arms 109*j*. When the spindle 109*b* comes down, these arms 109*j* lower, then retract inwardly to fit the wax tree 101 to the corresponding device. The spindle 109*b* rises again, rotates 60° in the opposite direction and lowers, and the arms 109*j* are then pushed outwardly to return to the original position. Between the slurry dipping device 104 and the excess slurry centrifuging device 105 and between the excess slurry centrifuging device 105 and the sanding device 106, motors (not shown) fitted to the arm seats 109h are used to rotate the wax trees to remove excess slurry, to prevent the slurry from uneven distribution, and to prevent excess sand from being scattered. Also, when treatment work in any of the devices is finished earlier than in the others, its wax tree is made ready to be removed and that device waits for the other devices to complete their works. If the device waiting is, for example, the slurry dipping device, it holds the wax tree to keep the tree away from the slurry fluid while waiting and simultaneously rotates the wax tree by means of a motor 104*e* to prevent the uneven distribution of the slurry as shown in FIG. 18. As described above, this automatic coating apparatus allows the coating work to be done by one worker, and if the adjustment and supply of materials are completed before operation, the worker only needs to perform a monitoring activity and is not required to perform heavy labor under a monotonous, hostile environment, whereby safety is ensured and production efficiency can be improved greatly.

In the conventional lost wax mold manufacturing apparatus designed as described above, the quantity and time allowed for consecutive automatic operation are limited by the shape and system of the carts which store the wax trees and the whole apparatus must be stopped to supply the materials such as the slurry and sand. Also, each device must be arranged at equal intervals on a circumference and the work time of the whole apparatus must be set to that of the device requiring the longest time. Further, the management of drying time after the formation of each coat, which is an important factor in retaining quality in the lost wax mold manufacturing, is not referred to for this apparatus. Furthermore, the ways of troubleshooting faults, such as wax tree breakage, are not described for this apparatus and fully unmanned operation cannot be performed, requiring the worker to continuously monitor the operation.

SUMMARY OF THE INVENTION

It is, accordingly, an object of the present invention to overcome the above disadvantages by providing an apparatus and a method for investment shell or lost wax mold manufacturing which automatically carry out an entire sequence of steps in the lost wax mold manufacturing process, ranging from after a wax tree manufacturing step to immediately before a dewaxing step. The invention also contemplates a system designed to respond to various working conditions and faults to retain the quality of lost wax molds and a control system engineered to perform the sequence of works on an unattended basis in order to ensure that unmanned operation may be performed after the apparatus is started. Further, the invention contemplates providing a product (part) manufacturing method using said method and apparatus.

DESCRIPTION OF THE PREFERRED EMBODIMENTS

Figure 1:
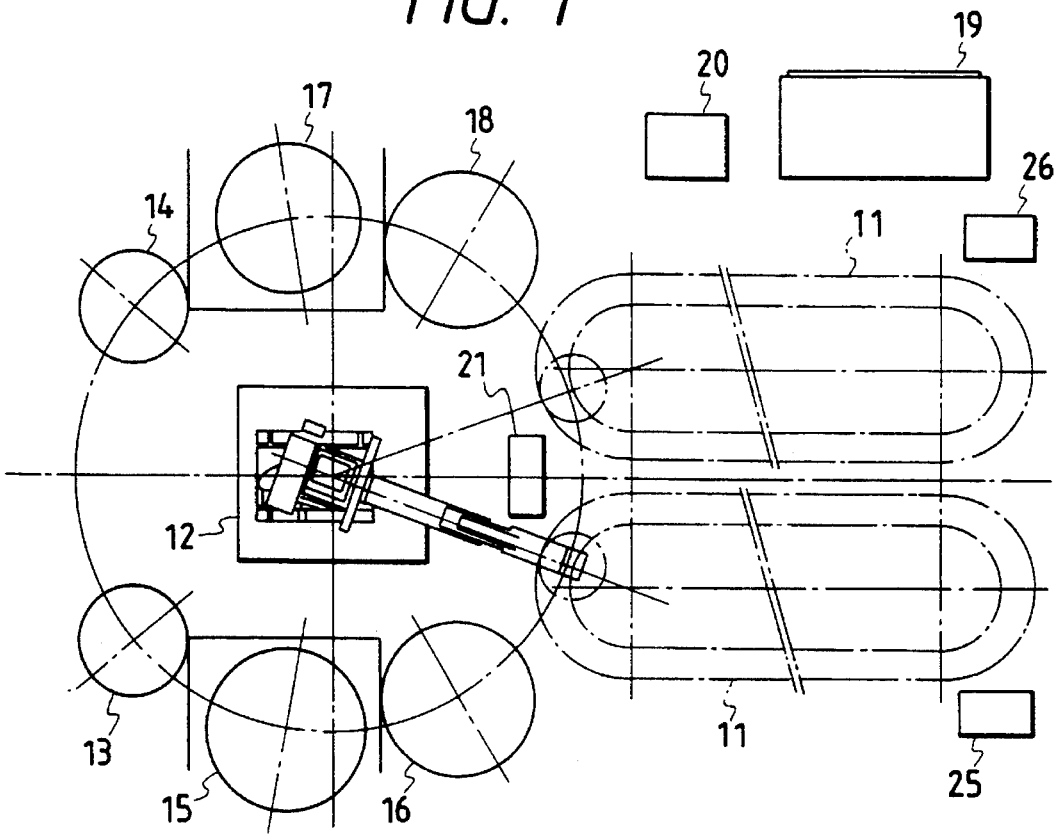
FIG. 1 is a plan view of a lost wax mold manufacturing apparatus, illustrating an embodiment of the present invention.

An embodiment of the present invention will now be described in accordance with the appended drawings. FIG. 1 is a plan view showing the planar layout of a lost wax mold manufacturing apparatus and showing the embodiment of the present invention. In this drawing, the numeral 11 indicates a pair of rotary hanger conveyors from which are suspended a plurality of wax trees. The trees may be suspended from the conveyors both before and after coating and the duration of a single round trip along the conveyor track is approximately the time required for a drying step. 12 denotes a handling device (a five-axis cylindrical coordinates robot in the drawing) which transfers the wax tree to and from the working position of each work station and may perform other operations at each station. As to the plurality of stations, 13 represents a degreasing bath which degreases and cleans the wax trees, 14 designates a pre-dipping bath employed for second coating, 15 indicates a slurry dipping bath for providing a first coating, 16 designates a fluidized bed tank for the first coating, 17 denotes a slurry dipping bath for second to seventh coatings, and 18 represents a fluidized bed tank for the second to the sixth coatings. 19 indicates a controller which exercises general control of the whole system, 20 represents an operation panel designed to set working conditions, etc., and operate the apparatus manually, 21 designates a breakage detection unit which detects the breakage of the wax trees, and 25 and 26 denote respective operation panels of the hanger conveyors 11.

Figure 2A:
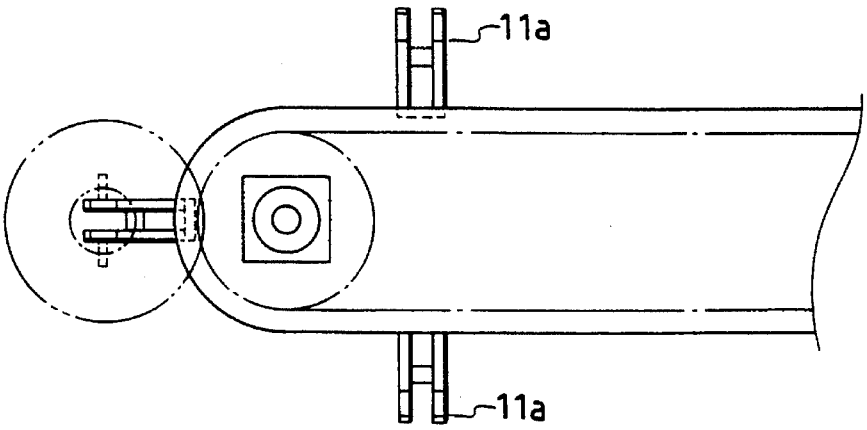
FIGS. 2*a*–2*b* are a partial plan view and partial front sectional view respectively of a hanger conveyor.
Figure 2B:
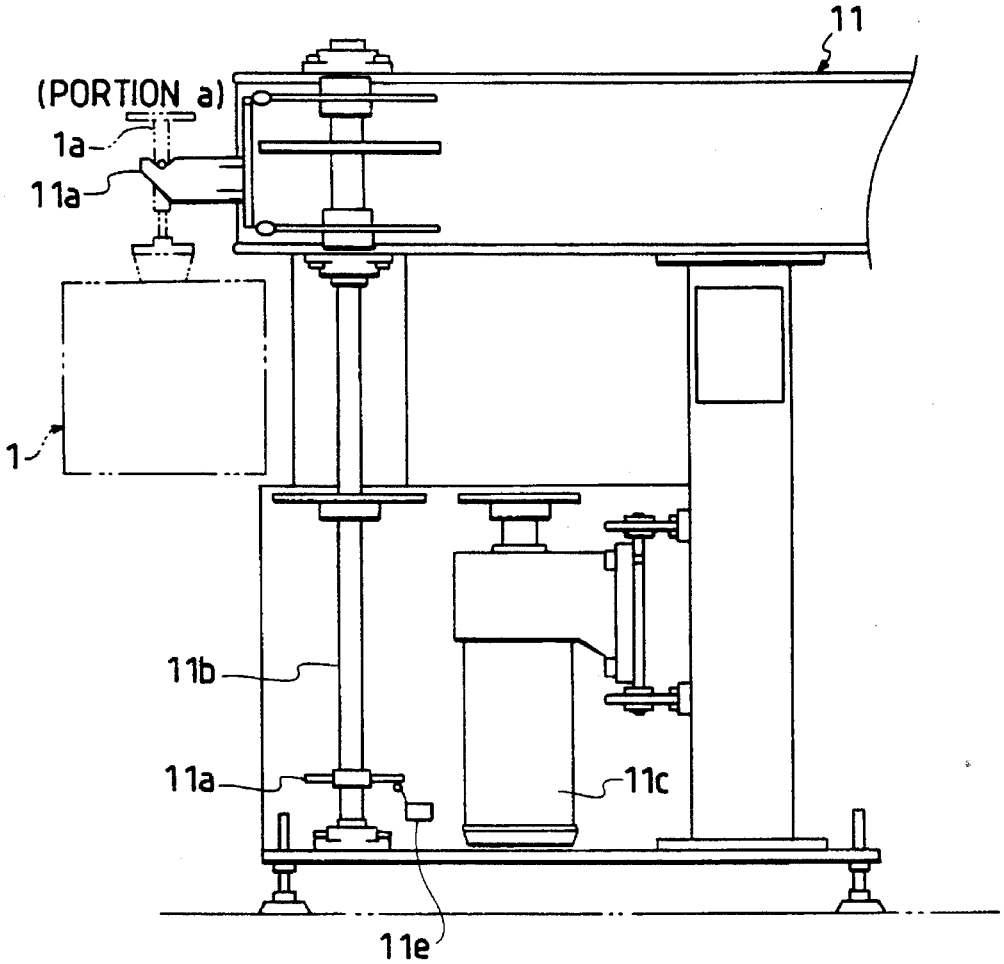

FIG. 2*a* is a partial plan view showing some details of the hanger conveyor 11 and FIG. 2*b* is a partial front sectional view thereof. 11*a* indicates hanger catches suspended with wax trees 1 and installed at given intervals in great numbers. 11*b* represents a drive shaft which drives the hanger catches 11*a* and is driven from a drive motor 11*c*. The drive shaft 11*b* is fitted with dogs 11*d* to actuate a limit switch 11*e* to stop the corresponding hanger catch 11*a* at a position where the wax tree 1 is transferred to the handling device 12.

Figure 3:
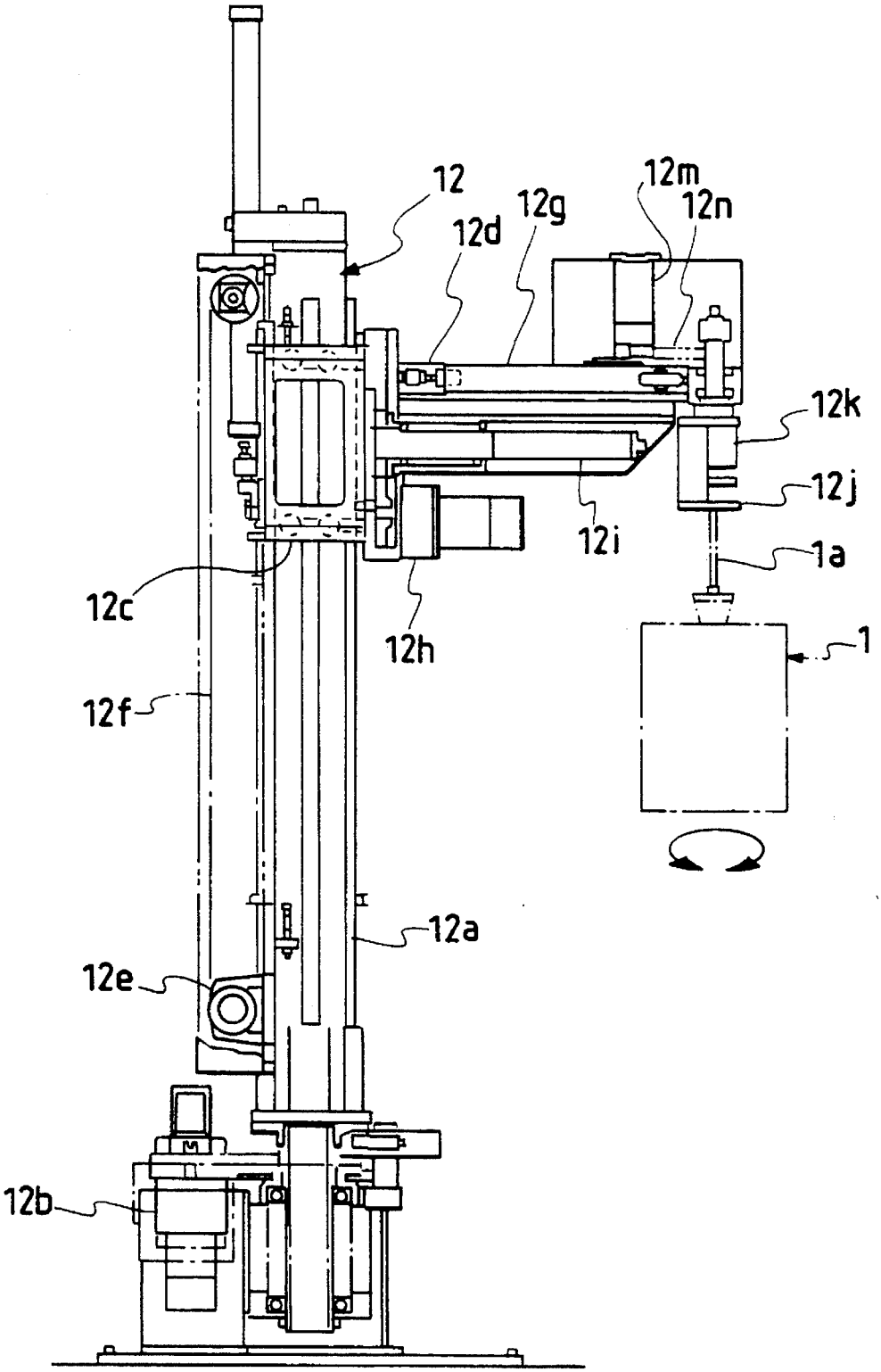
FIG. 3 is a front sectional view of a handling device in FIG. 1.

FIG. 3 is a front sectional view of the handling device 12, wherein 12*a* indicates a support which holds the handling device, 12*b* designates a motor designed to rotate the support 12*a* on the plane of FIG. 1, 12*c* represents a slider arranged to move an arm 12*d* up and down along the support 12*a*, 12*e* denotes a motor which moves the slider 12*c* up and down by means of a slider drive chain 12*f*, 12*g* indicates a cylinder designed to extend and retract the arm 12*d* in a side-to-side direction in FIG. 3, 12*h* represents a motor which swings the arm 12*d* around an arm swinging shaft 12*i*, 12*j* denotes a clamp unit which chucks the wax tree 1, 12*k* designates a clamping cylinder, and 12*m* indicates a motor which rotates the clamp unit 12*j*, is coupled by a timing belt 12*n*, and rotates in the direction of an arrow indicated in FIG. 3.

Figure 4:
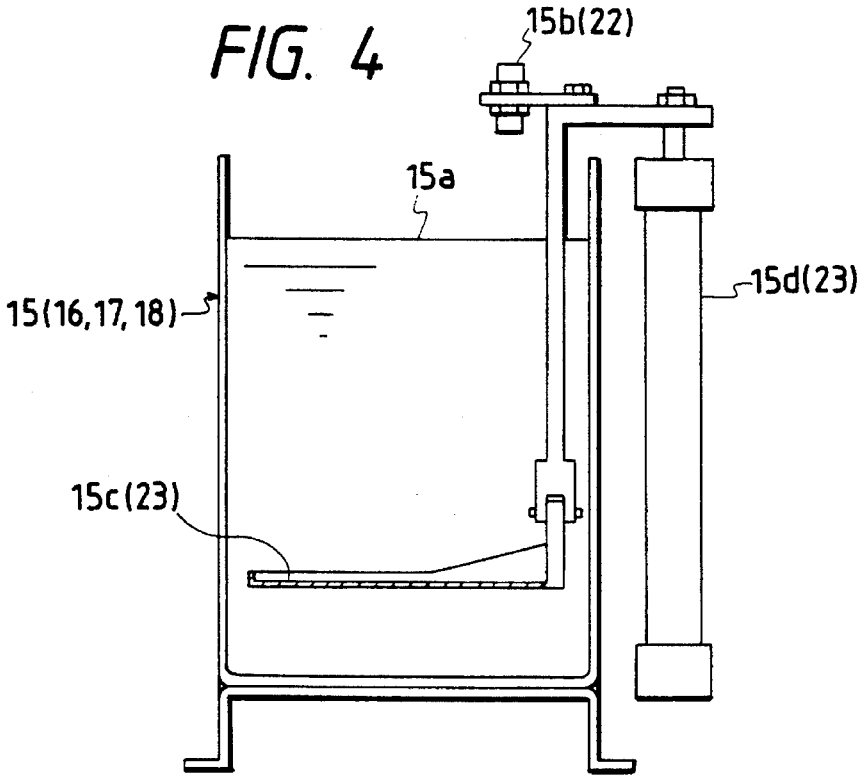
FIG. 4 is a front sectional view illustrating a unit which detects the fluid level of a slurry dipping bath and the height of the top surface of sand in a sanding fluidized bed tank and a unit which removes fallen wax parts in the lost wax mold manufacturing apparatus of the present invention.

FIG. 4 is a front sectional view showing a detection unit 22 which detects a fluid level or the top surface height of sand in the slurry dipping bath 15, 17 or the sanding fluidized bed tank 16, 18 and a fallen object removing unit 23 which eliminates any parts dropping from the wax tree, wherein 15*a* indicates the top surface of a slurry fluid or sand and 15*b* denotes a sensor which detects the fluid level or the top surface height of the sand. The fluid level or the sand top surface height detected by the sensor 15*b* is transmitted to the Controller 19, whereby the dipping depth of the handling device 12 into the slurry dipping bath 15, 17 or the sanding fluidized bed tank 16, 18 can be adjusted automatically. 15*c* represents a squirrel-cage case installed in the slurry bath or in the sanding fluidized bed tank and manufactured with a wire netting material, and 15*d* designates an actuator which moves the case 15*c* up and down to remove any wax parts that have fallen in the slurry bath or the sanding fluidized bed tank.

Figure 5:
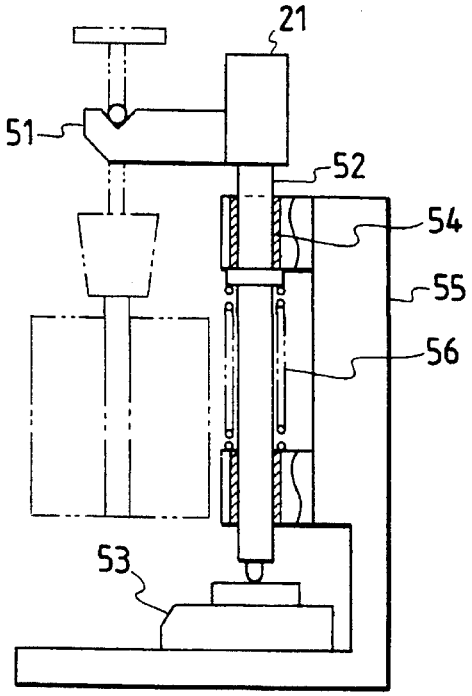
FIG. 5 is a partial front sectional view of a unit which detects wax tree breakage in the present invention.

FIG. 5 is a partial front sectional view illustrating a breakage detection unit 21 which detects the breakage of the wax tree 1, wherein 51 indicates a tree catch which catches the wax tree 1, 52 designates a transmission shaft which transmits weight applied to the tree catch 51 to a balance 53, 54 denotes a bearing used to retain the transmission shaft 52 slidably, 55 represents a frame which retains the breakage detection unit, and 56 indicates a spring provided to return the transmission shaft 52 when the wax tree 1 is removed. If the weight measured by the balance 53 is less than a given weight, it can be judged that part of the wax tree 1 chipped off or was broken.

Figure 6:
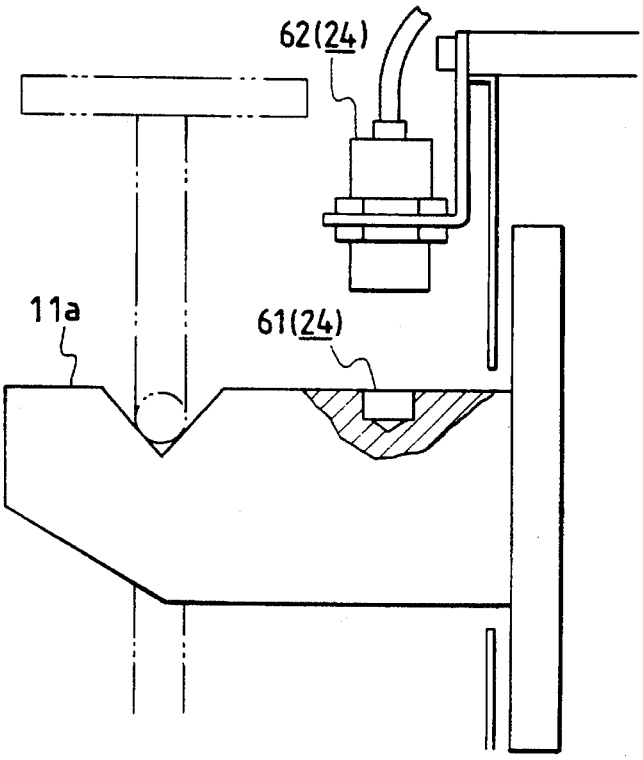
FIG. 6 is a partial front sectional view of a unit which identifies a wax tree type in the present invention.

FIG. 6 is a partial front sectional view showing an identification unit 24 designed to identify the type of the wax tree, wherein 61 indicates an ID tag fitted to the hanger catch 11*a* and 62 represents an antenna unit which reads and writes the contents of the ID tag. The contents read by the antenna unit 62 are sent to the controller 19 to allow the performance of various works and processes that differ, as among a plurality of wax trees 1.

If the breakage of the wax tree 1 has been detected by the breakage detection unit 21, its information is written to the ID tag 61.

A general control method of the devices described above will now be described.

Figure 7:
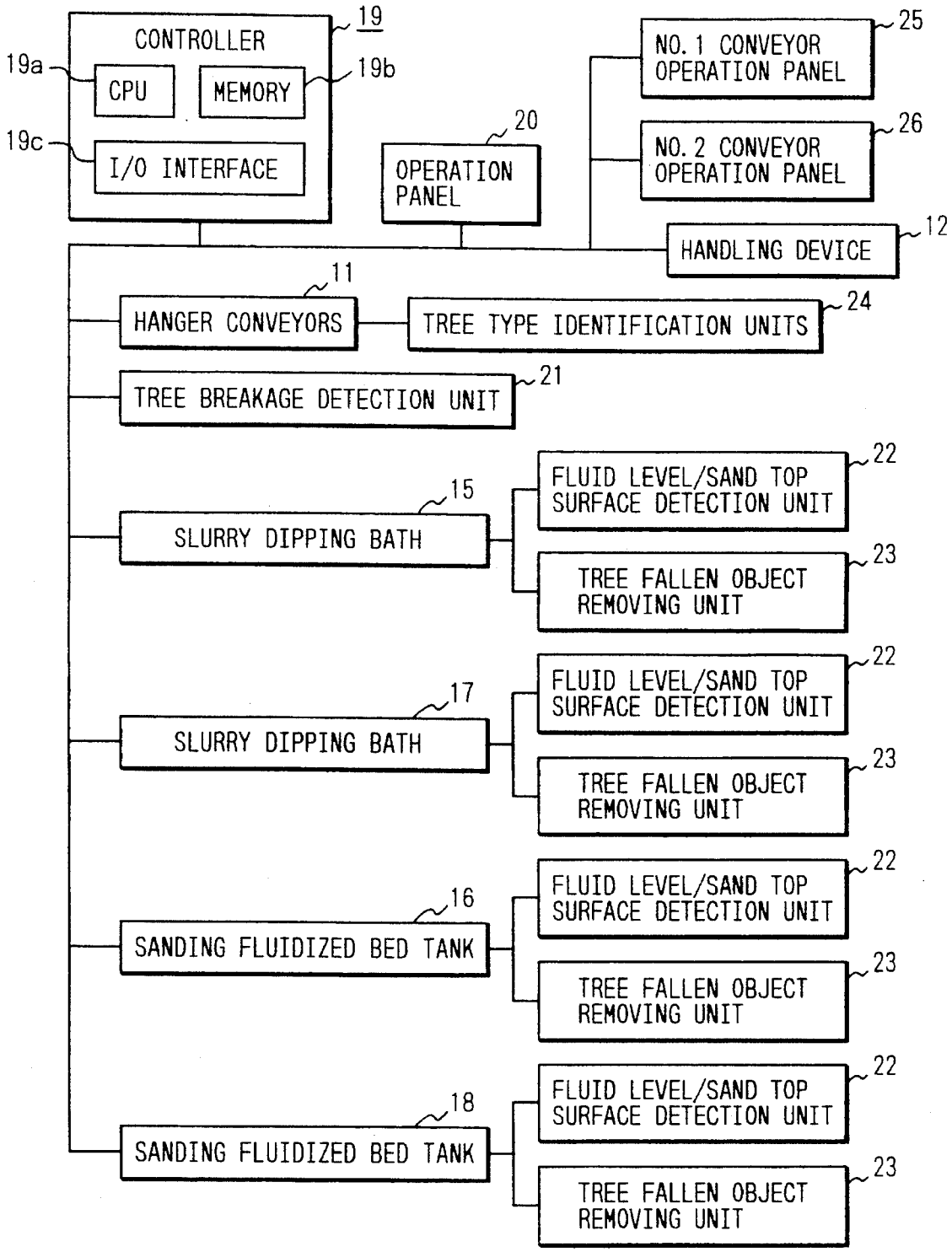
FIG. 7 is a system hardware configuration block diagram of the lost wax mold manufacturing apparatus, illustrating the embodiment of the present invention.
Figure 8:
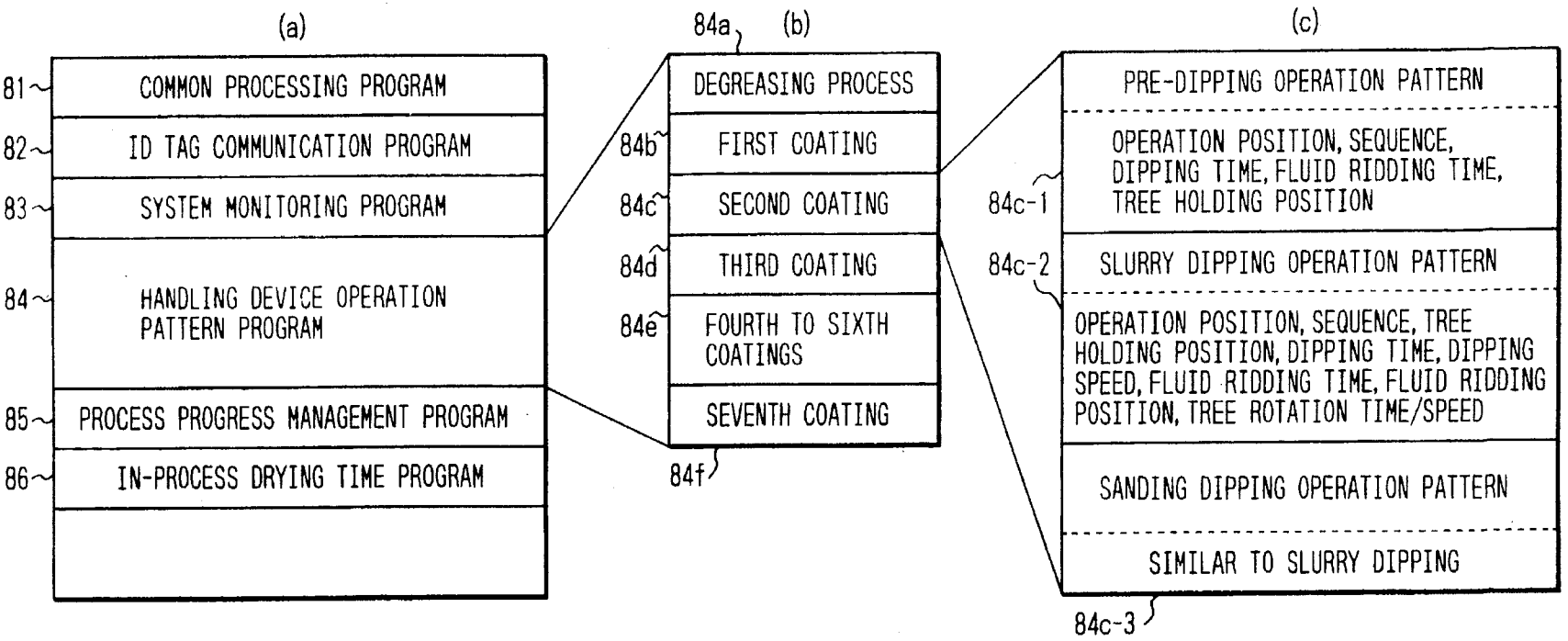
FIG. 8 illustrates a memory map of memory in the present invention.

FIG. 7 is a system hardware configuration block diagram showing the embodiment of the present invention, wherein the control lines of the devices and units described above are shown. The controller 19 is constituted by a CPU 19*a*, memory 19*b* and an I/O interface 19*c* and the overview of a memory map of the memory 19*b* is shown in FIG. 8. Other components of the system correspond identically to the elements of FIG. 1.

In FIG. 8, block (a) shows the memory map of the memory storing programs. 81 indicates a common processing program which, for example, readies, starts and stops this apparatus, sets an operation mode for automatic or manual operation, interlocks the units, and interfaces the programs. 82 designates a program for communicating with the ID tags 61 via the antenna units 62 fitted to the hanger conveyors as to whether there is wax tree breakage or not and which coating should be carried out. 83 represents a system monitoring program which batch-monitors the operating status of the present apparatus, work progress, product acceptance/rejection indication, etc., acting as a man-machine interface to the worker. 84 denotes a handling device operation pattern program which consists of degreasing process 84*a*, first coating 84*b*, second coating 84*c*, third coating 84*d*, fourth to sixth coating 84*e* and seventh coating 84*f* programs as shown in sub-block (b). In, for example, the second coating as shown in sub-block (c), operation patterns preprogrammed are classified into a pre-dipping operation pattern 84*c*-1, a slurry dipping operation pattern 84*c*-2 and a sanding dipping operation pattern 84*c*-3. As the pre-dipping operation pattern 84*c*-1, the operation pattern of gripping the wax tree 1 from the hanger conveyor 11, moving to the pre-dipping bath 14, and dipping the wax tree 1 into the pre-dipping bath 14 is preprogrammed, e.g., each operation position, sequence, tree holding position, dipping time, fluid ridding time and wax tree holding position. As the slurry dipping operation pattern 84*c*-2, data on the dipping into the slurry fluid after the completion of pre-dipping is preprogrammed, e.g., operation position, sequence, dipping time, dipping speed, fluid ridding time, fluid ridding position and wax tree rotating position and speed. As the sanding dipping operation 84*c*-3, almost the same items as in the slurry dipping operation pattern 84*c*-2 are preprogrammed. 85 indicates a process progress management program which manages the work directives of the processes from the degreasing process to the seventh coating process and the work status and the number of workpieces treated in each process in cooperation with the system monitoring program. When all wax trees have finished the "n"th coating process, the process progress management program 85 enters an "n"th drying process under the control of an in-process drying time program 86, and when given drying time has elapsed, starts the "n+1"th coating process.

Figure 9:
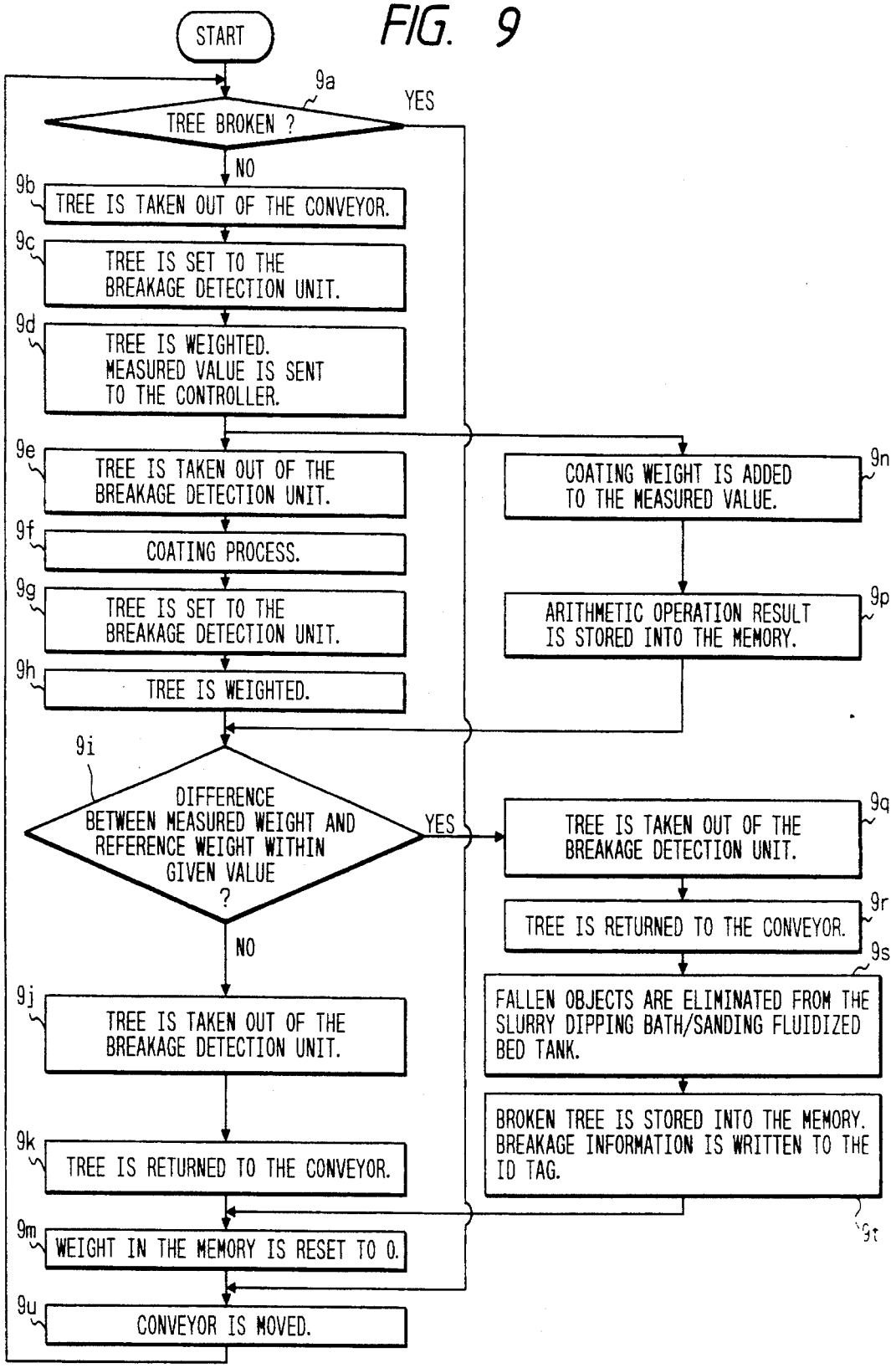
FIG. 9 is a flowchart used to describe the operation of the present invention.
Figure 10A:
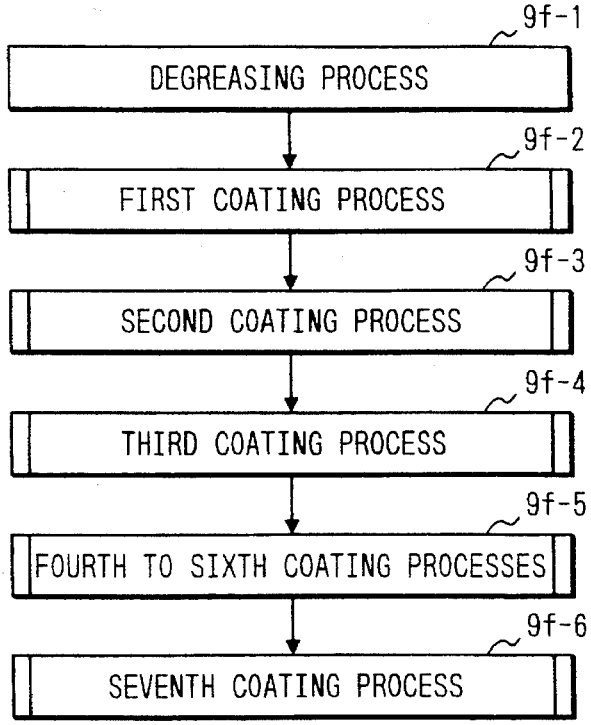
FIGS. 10*a*–10*d* illustrate the details of the coating processes in the present invention.
Figure 10B:
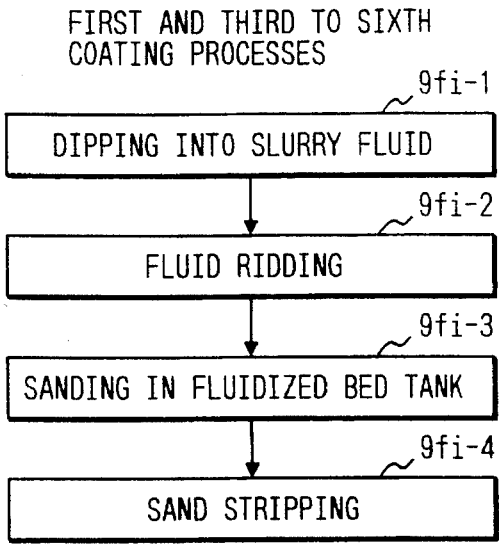
Figure 10C:
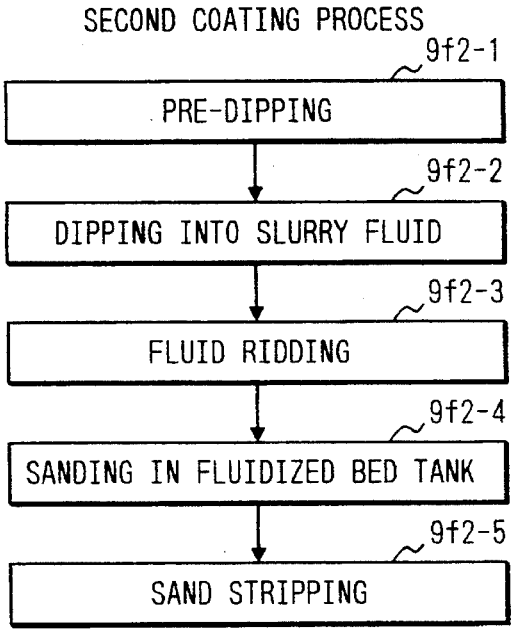
Figure 10D:
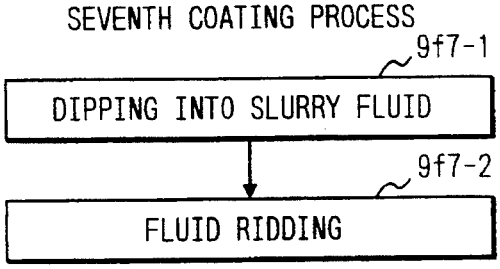

FIG. 9 is a flowchart showing the operation of the preferred embodiment, wherein the conveyor is stopped at a position where the wax tree is transferred to the handling device 12, the controller 19 starts the ID tag communication program, reads data written on the ID tag to the antenna unit 62, and checks whether or not there is information on whether the wax tree was broken or not (step 9*a*), and if it was broken, proceeds to step 9*u* to move the conveyor and check the next wax tree for breakage. If the wax tree was not broken, the handling device 12 moves to the wax tree 1 transfer position of the hanger conveyor 11 under the directive of the controller 19, grips the wax tree 1 suspended on the hanger catch 11*a* of the hanger conveyor, and removes it from the hanger conveyor (step 9*b*). Then, the handling device 12 sets the wax tree 1 to the tree catch 51 of the breakage detection unit 21, unchucks it (step 9*c*), weighs the wax tree 1, and transmits that data to the controller 19 (step 9*d*). Subsequently, the handling device 12 chucks the wax tree 1 again and takes it out of the breakage detection unit 21 (step 9*e*), and the operation enters the coating process (step 9*f*). The coating process 9*f* is made up of processes indicated in FIG. 10*a*, i.e., a degreasing (step 9*f*-1) and first to seventh coating processes (steps 9*f*-2 to 9*f*-6). In any of the first and the third to sixth coating processes, the wax tree is dipped in the slurry fluid (step 9*fi*-1), is taken out of the slurry fluid and rid of the fluid (step 9*fi*-2), is then sanded in the fluidized bed tank (step 9*fi*-3), and is stripped of sand (step 9*fi*-4) as shown in FIG. 10*b*. In the second coating process, pre-dipping (step 9*f*2-1) is added to the steps in FIG. 10*b* as indicated in FIG. 10*c*. The seventh coating process consists of only dipping (step 9*f*7-1) and fluid ridding (step 9*f*7-2) as shown in FIG. 10*d*. It is to be noted that as shown in FIG. 8, the slurry dipping operation pattern and the sanding operation pattern can be changed in the first to the seventh coating processes.

Returning to FIG. 9, the wax tree that has completed the coating process is set to the breakage detection unit 21 again (step 9*g*), the wax tree 1 coated is weighed, and weight data is sent to the controller 19 and is compared with reference weight stored in the memory 19*b* of the controller 19 (step 9*i*). The addition result of the pre-coating weight measured in step 9*d* and the pre-measured coating weight (step 9*n*) is stored into the memory 19*b* as the reference weight (step 9*p*). If some portion of the wax part of the wax tree 1 was broken or chipped off due to the resistance of the slurry fluid or sand, the wax tree 1 is lighter than the reference weight stored in the memory 19*b*, whereby it can be judged whether the wax tree 1 was broken or not. This judgement is made in step 9*i*. If not broken, the wax tree 1 is removed from the breakage detection unit 21 by the handling device 12 (step 9*j*) and returned to the hanger conveyor 11 (step 9*k*), the weight of the wax tree 1 in the memory 19*b* is reset to zero (step 9*m*), the hanger conveyor 11 is rotated a given distance (step 9*u*), and the operation returns to step 9*a* for the chucking of the next wax tree 1. If the wax tree 1 was judged as broken in step 9*i*, the operation progresses to step 9*q*, the wax tree 1 is removed from the breakage detection unit 21 by the handling device 12 (step 9*q*) and returned to the hanger conveyor 11 (step 9*r*), the actuators 15*d* of the fallen object removing units 23 on the slurry dipping bath and the sanding fluidized bed tank are operated to eliminate the fallen objects from the bath and the tank (step 9*s*), the breakage information of the wax tree broken is written to the memory 19*b* and the ID tag 61 (step 9*t*), and the operation moves on to step 9*m*.

Figure 11:
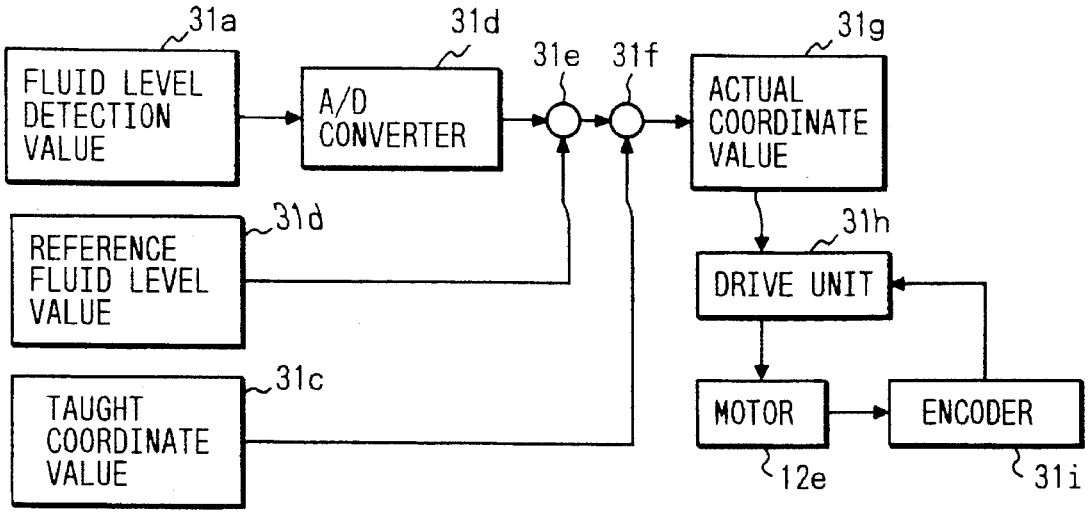
FIG. 11 is a processing block wherein a fluid level and sand top surface height are detected and processed in the present invention.
Figure 12:
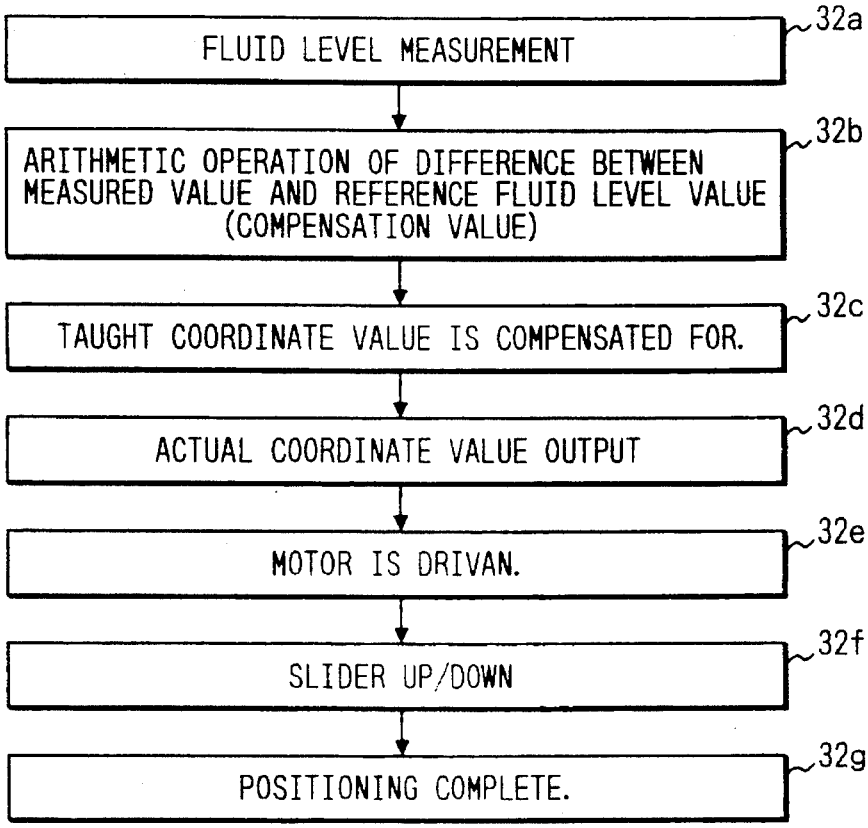
FIG. 12 is a flowchart for FIG. 11.

FIG. 11 is a processing block diagram for use with the sensor which detects the fluid level or the top surface height of sand, and FIG. 12 is a flowchart thereof. The fluid level or sand top surface height 31*a* is detected by the sensor 15*b* (step 32*a*), is converted into a digital value by an analog-to-digital converter 31*d*, and is compared with a reference fluid level or sand top surface height 31*b* stored beforehand in the memory 19*b*, a difference therebetween is operated on by an adder/subtractor 31*e* (step 32*b*), the coordinate value of the fluid level or sand top surface height at the teaching time of the handling device 12 is compensated for (added or subtracted) by an adder/subtractor 31*f* according to said difference (step 32*c*), the actual coordinate value is output to a drive unit 31*h* installed in the controller 19 (step 32*d*), the motor for moving the slider 12*c* up/down is driven (step 32*e*) to move the slider 12*c* up/down (step 32*f*), whereby dip positioning can be done appropriately if the fluid level of the slurry dipping bath or the sand top surface of the sanding fluidized bed tank varies (step 32*g*).

Figure 13:
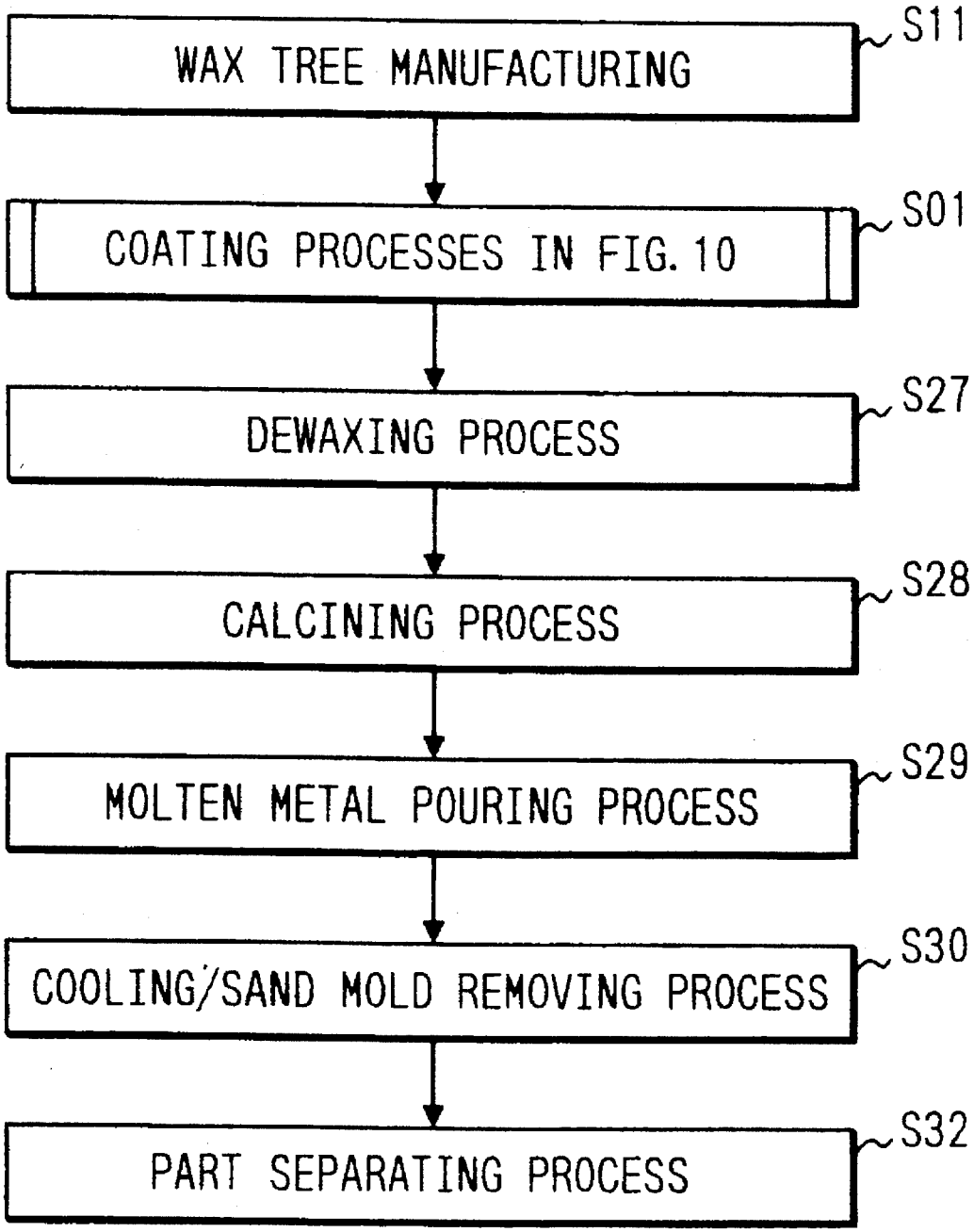
FIG. 13 is a flowchart in which the coating method of the present invention is used to manufacture cast products.
Figure 14A:
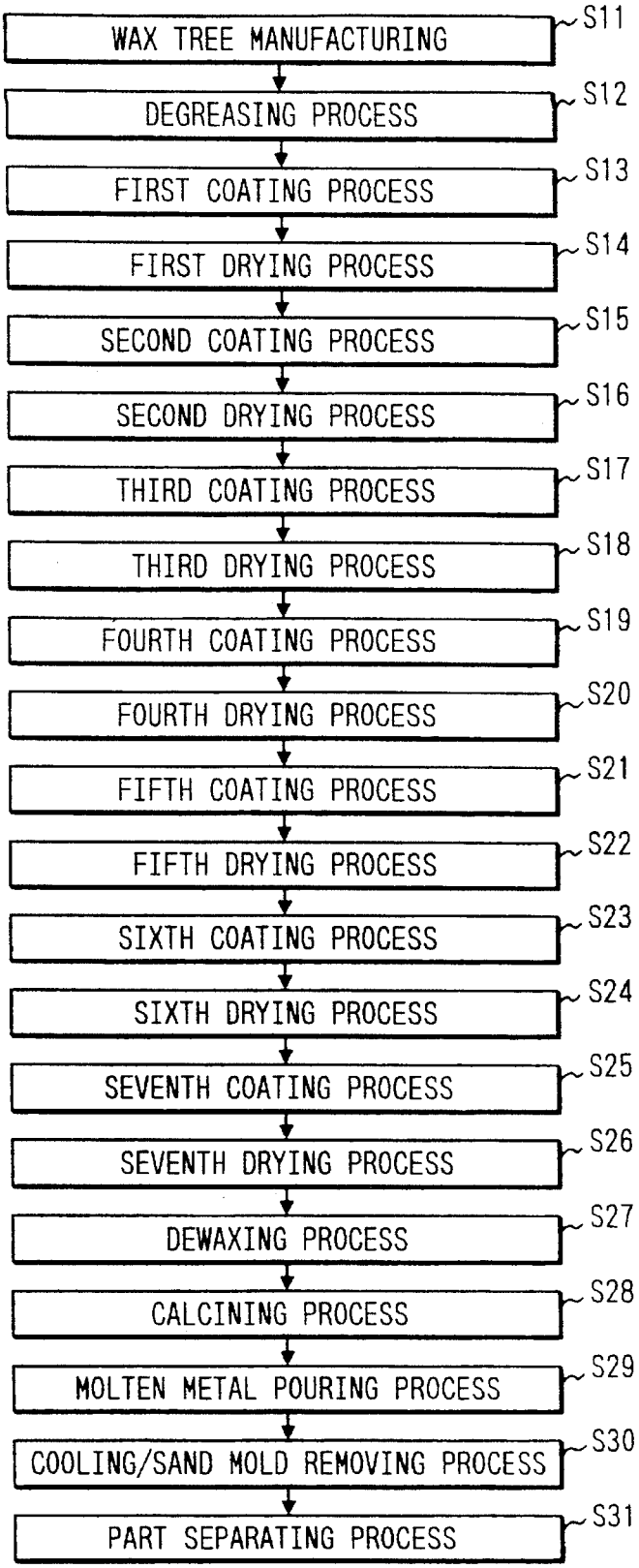
FIGS. 14*a*–14*d* is a flowchart illustrating lost wax process steps from wax tree manufacturing to parts manufacturing.
Figure 14B:
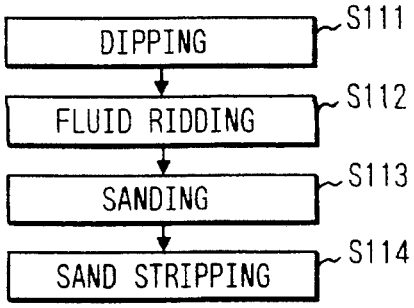
Figure 14C:
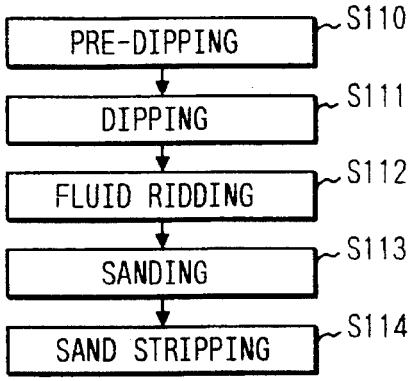
Figure 14D:
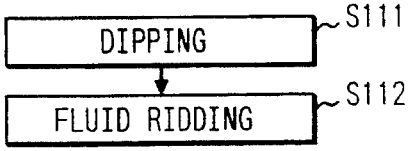

The cast parts manufacturing process by means of lost wax according to the present invention shown in FIG. 13 allows steps S12 to S26 in FIG. 14 described in the BACKGROUND OF THE INVENTION to be automatic and unmanned. In FIG. 13, step S01 consists of the processes shown in FIG. 10*a* to FIG. 10*d*.

Further, items devised in each process relevant to the quality of the molds or cast parts will now be described.

First, in the first coating process, the surface quality of the cast parts is determined by this coating as described previously. When the wax tree is dipped at right angles to the fluid surface into the slurry fluid of the slurry dipping bath, bubbles are likely to be entrapped, remain between the wax tree and the slurry fluid, and project from the casting surface of the cast part. To prevent this, the wax tree 1 is moved to above the slurry dipping bath 15 by the handling device 12, the motor 12*h* is now driven to slant the wax tree 1 at a proper angle, e.g., 20° or 30°, according to the tree holding position stored in the slurry dipping operation pattern 84*c*-2 of the memory 19*b*, and further the clamp unit 12*j* is rotated by the motor 12*m* to rotate the wax tree. Subsequently, to prevent the slurry fluid in the first coating bath from being gelled, an agitating pump (not shown) which had been agitating the slurry fluid is stopped. Then, the wax tree 1 held by the clamp unit 22 and rotating in a slightly slanted position is gradually sunk into the slurry fluid as the slider 12*c* lowers. The dipping depth of the wax tree 1 into the slurry fluid is controlled in accordance with the change of the slurry fluid level as described in FIGS. 11 and 12 to prevent the build-up of the slurry fluid on the sprue provided at the top (clamp unit side) of the wax tree 1. The wax tree 1 dipped in the slurry fluid is changed in slant inside the slurry fluid by the swing operation of the arm 12*d*.

The wax tree 1 which has completed slurry fluid dipping is pulled up from inside the slurry fluid as the slider 12*c* rises, the arm 12*d* is tilted at a proper angle, e.g., 120° or 150°, by the arm swinging motor 12*h*, and the tree is rotated by the motor 12*m* for a given period of time. This is performed to prevent the slurry fluid from dripping from the wax tree and to ensure that the slurry fluid builds up evenly on the wax tree.

Then, the slurry fluid agitating pump is started up to agitate the slurry fluid, the support 12*a* of the handling device 12 is rotated by the motor 12*b*, an air valve (not shown) on the first sanding fluidized bed tank 16 is switched on to float the sand, and the rotation of the support 12*a* (i.e., the horizontal swing of the arm 12*d*) is stopped above the fluidized bed tank 16. The wax tree 1 is kept rotated after the slurry fluid dipping, the arm 12*d* is swung at the stop position above the fluidized bed tank 16 to cause the wax tree 1 to take an appropriate slanting position, and the wax tree 1 is lowered into the sand as the slider 12*c* goes down. The slant of the wax tree 1 is changed within the sand so that the sand builds up evenly.

To prevent the coating work from being interrupted by the drying process required between the "n"th coating process and the "n+1"th coating process, the wax tree that has completed the "n"th coating process is dried on one hanger conveyor and simultaneously the other wax tree that has completed drying on the other hanger conveyor is subjected to the "n+1"th coating process, whereby the coating work can be continued without the apparatus being interrupted.

Figure 15:
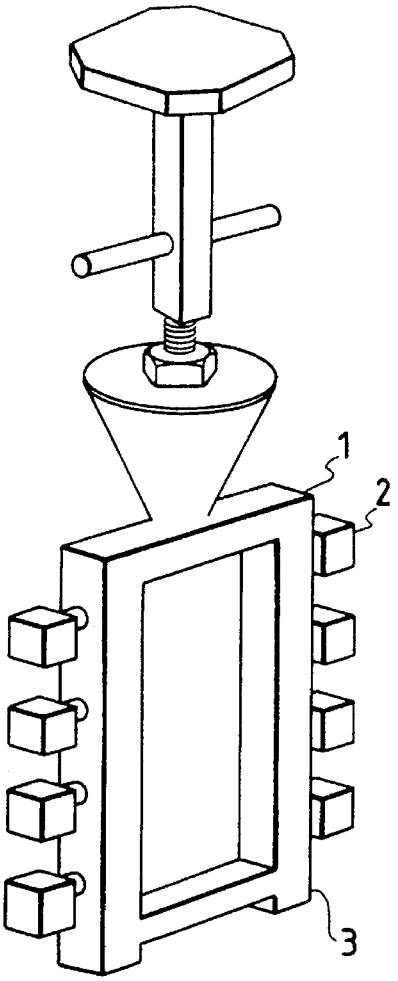
FIG. 15 illustrates an example of a wax tree.
Figure 16:
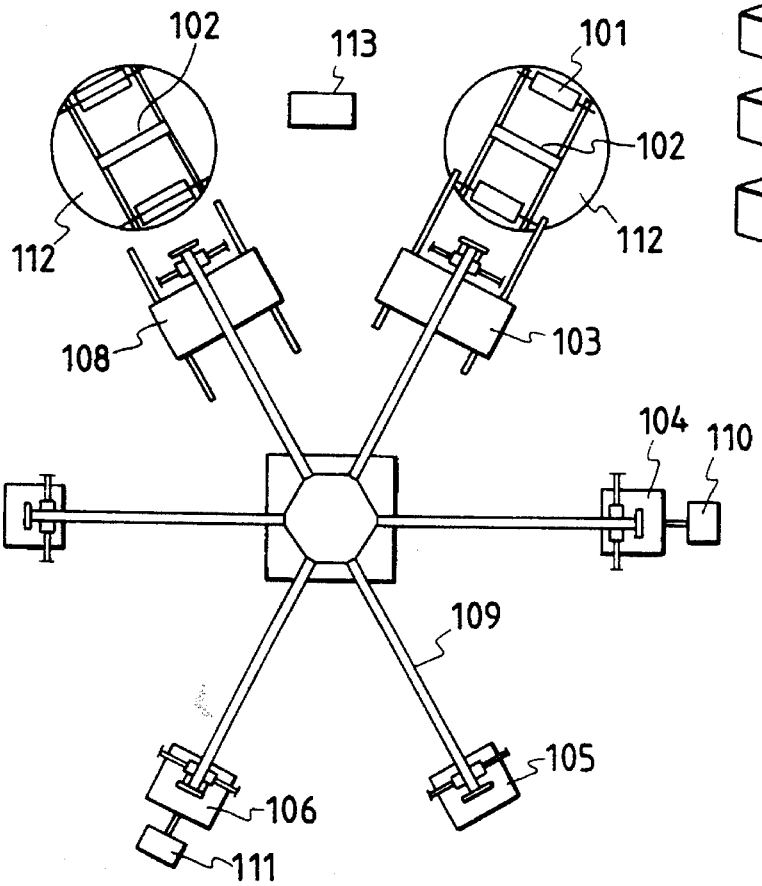
FIG. 16 is a plan view of a conventional automatic coating apparatus presented in Japanese Laid-Open Patent Publication SHO55-86657.
Figure 17A:
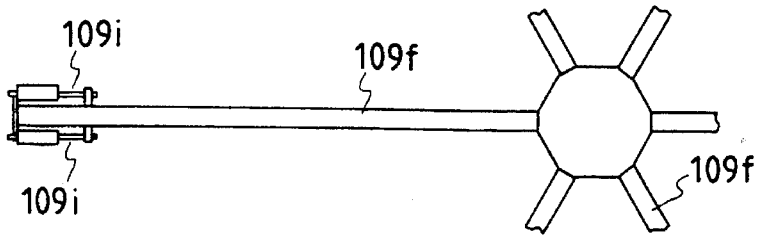
FIGS. 17*a*–17*b* are a partial plan view and partial front view respectively of a wax tree feeding device in FIG. 16.
Figure 17B:
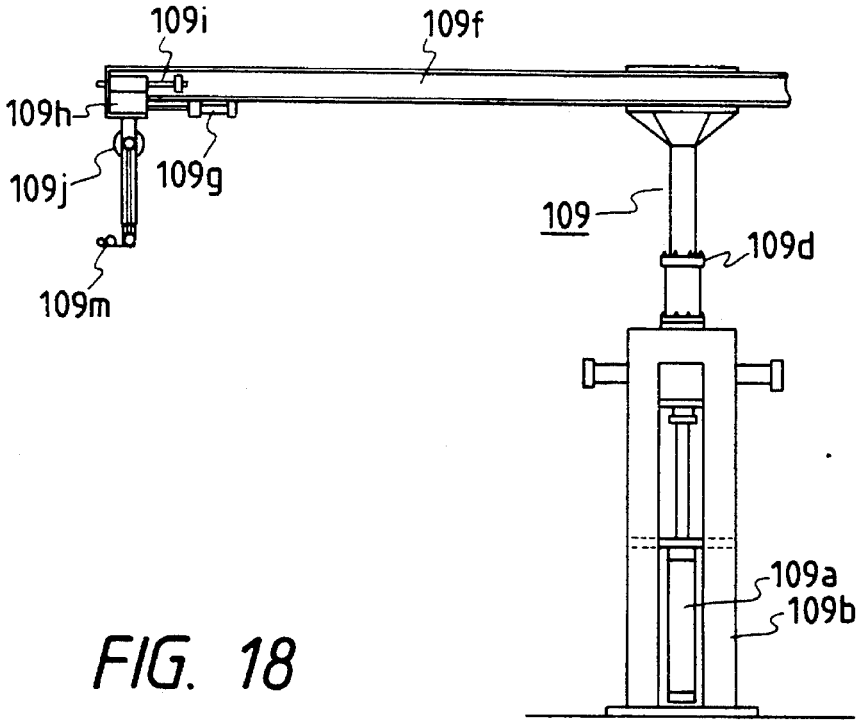
Figure 18:
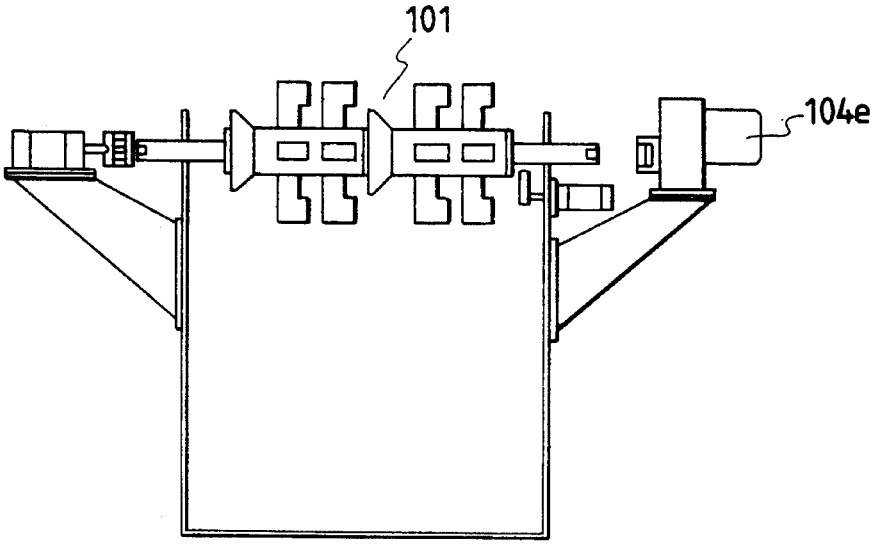
FIG. 18 is a front sectional view of a slurry dipping device in FIG. 16.

The hanger conveyors designed to dry and transfer the wax trees in said embodiment, which are stable in the storage position when the wax trees are shaped as shown in FIG. 15, may be replaced by mounting-type conveyors depending on the shape of the wax trees. Also, the conveyors need not be of the rotary type if they return to the wax tree transfer position of the handling device in given drying time (two or three hours). Specifically, since one wax tree requires about three or four minutes for a single cycle of coating (from when the wax tree is taken out of the conveyor until when it is coated and returned to the conveyor), the present invention is applicable to a case where the wax tree coated is loaded on an automatic guided vehicle by the handling device and moved to another place for drying.

Further, since wax tree breakage almost always occurs in the form that its product mold chips off the tree, the method of detecting wax tree breakage in terms of the wax tree weight as presented in FIG. 5 may be substituted by an image processing method in which a wax tree image imported by a CCD camera is compared with an after-coating reference image stored beforehand in image memory with the wax tree after completion of the coating process held by the handling device, whereby the time of loading/unloading the wax tree to/from the breakage detection unit as shown in FIG. 5 can be reduced.

According to the present invention, as described above, a pair of conveyors are provided to allow the coating work of wax trees to be continued on one conveyor while wax trees are being dried on the other conveyor, whereby the coating work can be executed efficiently.

Also, cast parts different in type can be coated by the same apparatus because the grips 1*a* of the wax trees held by the clamp unit of the handling device are the same.

Further, the wax trees are weighed before and after each coating and checked for breakage, any breakage found is stored into the ID tag to keep subsequent coating work from being done, and the slurry dipping bath and sanding fluidized bed tank are cleared of broken parts before the work is resumed, thereby preventing the slurry fluid and sand from being degraded in quality.

Furthermore, the dipping depths of the wax trees are adjusted according to the fluid level and sand top surface height detected to ensure that the wax trees can be dipped to the same depth if the level and height lower as the coating advances, thereby preventing the slurry fluid from building up on the sprue of the wax tree.

All of the above features permit effective unmanned operation.

Although this invention has been described in at least one preferred embodiment with a certain degree of particularity, it is to be understood that the present disclosure of the preferred embodiment has been made only by way of example and that numerous changes in the details and arrangement of components may be made without departing from the spirit and scope of the invention as hereinafter claimed.

What is claimed is:

1. A wax tree coating apparatus comprising:

a handling device for handling wax trees, said device comprising an arm moveable within a working area;

at least two slurry fluid dipping baths disposed within said working area;

at least two sanding fluidized bed tanks disposed within said working area; and transfer means for storing said wax trees for drying;

said handling device being operative for automatically moving said wax tree from said transfer means, moving said wax tree to said slurry fluid dipping bath for dipping, moving said wax tree to said sanding fluidized bed tank for coating said wax tree with a slurry fluid and sand, and returning the wax tree coated to said transfer means for drying.

2. The wax tree coating apparatus as defined in claim 1, wherein said transfer means comprises at least two conveyors for suspending and transferring said wax trees for not less than a desired drying time.

3. The wax tree coating apparatus as defined in claim 2, wherein said conveyors are rotary hanger conveyors.

4. The wax tree coating apparatus as defined in claim 1, further comprising detecting means for detecting the status of changes taking place in said wax trees after application of a coating.

5. The wax tree coating apparatus as defined in claim 4, wherein said detecting means comprises means for weighing said wax tree.

6. The wax tree coating apparatus as defined in claim 1, further comprising removing means for eliminating objects broken from said wax tree from at least one of said slurry fluid dipping baths and sanding-fluidized bed tanks.

7. The wax tree coating apparatus as defined in claim 1, wherein said handling device comprises a five-axis cylindrical coordinates robot.

8. The wax tree coating apparatus as defined in claim 1, wherein said handling device further comprises clamp means for clamping said wax tree in a vertically suspended orientation.

9. The wax tree coating apparatus as defined in claim 1, further comprising detecting means for detecting the status of each wax tree and identifying means for uniquely identifying each wax tree.

10. The wax tree coating apparatus as defined in claim 9, further comprising processing means operative in conjunction with said detecting means and said identifying means for automatically producing wax tree products.

11. An automatic investment shell mold manufacturing method in a wax coating apparatus comprising a handling device having an arm for handling investment shell molds within a work area, at least two slurry fluid dipping baths disposed within said work area, at least two sanding fluidized bed tanks disposed within said work area, and a movable drying means for suspending and transferring said investment shell molds during a drying time, said method comprising:

(1) placing said investment shell mold on said movable drying means with said handling device;

(2) removing said investment shell mold from said drying means with said handling device;

(3) transferring said investment shell mold taken from said drying means to said slurry fluid dipping bath and dipping said investment shell mold in said bath;

(4) transferring said dipped investment shell mold to said sanding fluidized bed tank and coating said mold with sand;

(5) returning said investment shell mold coated with sand to said drying means; and (6) repeating said steps (1) to (5) a plurality of times.

12. The investment shell mold manufacturing method as defined in claim 11, wherein said steps (1) to (5) are conducted by said handling device.

13. The investment shell mold manufacturing method as defined in claim 11, further comprising:

(1) checking said investment shell mold after coating with sand for breakage; and (2) cleaning at least a corresponding one of said slurry fluid dipping bath and said sanding fluidized bed tanks if the breakage of said investment shell has been detected.

14. The investment shell mold manufacturing method as defined in claim 11, further comprising:

(1) checking said investment shell mold after coating with sand for breakage; and (2) identifying said investment shell mold as damaged.

15. The investment shell mold manufacturing method as defined in claim 13, wherein said checking step comprises weighing said investment shell mold and comparing the result of said weighing against a reference value.

16. The investment shell mold manufacturing method as defined in claim 14, wherein said checking step comprises weighing said investment shell mold and comparing the result of said weighing against a reference value.

17. The investment shell mold manufacturing method as defined in claim 11, further comprising:

detecting the level of a slurry fluid within at least one of said slurry fluid dipping baths; and adjusting the downstroke of said handling device according to said detected level of slurry fluid.

18. The investment shell mold manufacturing method as defined in claim 11, further comprising:

heating said mold to remove said wax; and pouring a molten substance into said mold for forming by the inner contour of said mold.

19. A cast product manufacturing method using an automatic investment shell mold manufacturing method in a wax tree coating apparatus comprising a handling device having an arm for handling a wax tree within a work area, at least two slurry fluid dipping baths disposed within said work area, at least two sanding fluidized bed tanks disposed within said work area, and a movable drying means for suspending and transferring said wax trees during a drying time, comprising:

(1) using a wax material to make a wax tree comprising a plurality of wax product patterns;

(2) coating said wax tree with sand by the following steps:

(a) placing said wax tree on said movable drying means with said handling device;

(b) removing said wax tree from said drying means by said handling device;

(c) transferring said wax tree taken from said drying means to said slurry fluid dipping bath and dipping said wax tree in said bath by said handling device;

(d) transferring said dipped wax tree to said sanding fluidized bed tank for coating with sand by said handling device;

(e) returning said wax tree coated with sand to said drying means by said handling device; and (f) repeating said steps (a) to (e) a plurality of times until a desired mold thickness is formed;

(3) dewaxing said coated molds from said wax tree by heating;

(4) calcinating said dewaxed sand molds; and (5) pouring a molten metal into said calcined sand molds.

20. A cast product manufacturing method using cast molds by means of lost wax, comprising:

(1) using a wax material to make a wax tree comprising a plurality of wax product patterns;

(2) coating said wax tree with sand by the following automatically controlled steps:

(a) placing said wax tree on a drying means with a handling device having an arm for handling a wax tree within a work area;

(b) removing said wax tree from the drying means by the handling device;

(c) transferring said wax tree taken from said drying means to a slurry fluid dipping bath within said work area and dipping said wax tree in said bath by said handling device;

(d) transferring said dipped wax tree to a sanding fluidized bed tank within said work area for coating with sand by said handling device;

(e) returning said wax tree coated with sand to said drying means by said handling device; and (f) repeating said steps (a) to (e) a plurality of times until a desired mold thickness is formed;

(3) dewaxing said coated molds from said wax tree by heating;

(4) calcinating said dewaxed sand molds; and (5) pouring a molten metal into said calcined sand molds.

* * * * *